United States Patent [19]

Newman

[11] 4,042,092

[45] * Aug. 16, 1977

[54] DUPLICATING METHOD

[75] Inventor: Douglas A. Newman, Glen Cove, N.Y.

[73] Assignee: Columbia Ribbon & Carbon Mfg. Co., Inc., Glen Cove, N.Y.

[ * ] Notice: The portion of the term of this patent subsequent to Feb. 10, 1993, has been disclaimed.

[21] Appl. No.: 599,718

[22] Filed: July 28, 1975

Related U.S. Application Data

[63] Continuation-in-part of Ser. No. 302,188, Oct. 30, 1972, Pat. No. 3,937,178.

[51] Int. Cl.[2] ..... B41J 31/14

[52] U.S. Cl. ..... 197/171; 197/172; 118/46; 427/141; 427/428

[58] Field of Search ..... 118/46; 197/171, 172, 197/151; 427/141, 153, 428; 101/336

[56] References Cited

U.S. PATENT DOCUMENTS

| | | | |
|---|---|---|---|
| 2,699,245 | 1/1955 | Hernandez | 197/171 |
| 2,755,905 | 7/1956 | Segui | 197/171 X |
| 3,037,879 | 6/1962 | Newman et al. | 427/153 X |
| 3,110,386 | 11/1963 | Raines | 197/172 |
| 3,232,406 | 2/1966 | Schwartz | 197/171 |
| 3,377,598 | 4/1968 | Borman | 197/171 X |
| 3,681,186 | 8/1972 | Findlay et al. | 197/172 UX |
| 3,887,056 | 6/1975 | Lehmann | 197/171 X |
| 3,895,130 | 7/1975 | Barouh et al. | 427/153 X |
| 3,904,802 | 9/1975 | Brown et al. | 427/153 X |
| 3,908,063 | 9/1975 | Rosendale et al. | 427/153 X |
| 3,937,178 | 2/1976 | Newman | 197/171 X |

*Primary Examiner*—Edgar S. Burr
*Assistant Examiner*—Paul T. Sewell
*Attorney, Agent, or Firm*—Thomas L. Tully

[57] ABSTRACT

Continuous ink-supply method for duplicating machines such as typewriters to alleviate the necessity for using and replacing conventional ribbons. Method employs a thin film strip or band which has an affinity for liquid ribbon ink, and an inking means for continuously supplying a thin continuous layer of liquid ink to the surface of said film.

8 Claims, 4 Drawing Figures

DUPLICATING METHOD

This application is a continuation-in-part of parent application, Ser. No. 302,188, filed Oct. 30, 1972, now U.S. Pat. No. 3,937,178.

Duplicating machines such as typewriters, chain printers, and the like, employ a conventional duplicating ribbon to supply ink to a copy sheet under the effects of typing or printing pressure. Such ribbons, of the fabric or film-base type, are disadvantageous because their caliper or thickness causes a broadening or lateral spreading of the impact force which can result in typed images which are broader and less sharp than desired. Fabric ribbons are generally woven from filaments such as silk or nylon and impregnated with liquid ink. Fabric ribbons have certain additional disadvantages such as the fabric imprint they impart to the typed images, degradation of the imaging strength with age and limited ink capacity requiring frequent replacement.

Film-base ribbons have a film foundation carrying a solid waxy or resinous ink layer. Such ribbons do not impart a fabric imprint to the typed or printed images. However they are mainly single-use ribbons having frangible ink layers which produce solid images which can smear on contact. The only ones suitable for reuse and which exude liquid ink are those having a resinous squeeze-out type ink layer, illustrated for instance by U.S. Pat. No. 3,037,879. Such reusable ribbons enjoy widespread commercial success but are relatively expensive and also have a limited period of reuse.

The present invention is concerned with avoiding the problems presented by conventional duplicating ribbons and with providing a novel ink-supply method for typewriters and printing machines which is not limited by the ink-carrying capacity of the ribbon.

It is another object of this invention to provide an ink-supply method for duplicating machines whereby a continuous, thin, uniform supply of liquid ink is applied to a plastic film for transfer by the impact element, such as a type face, to the copy sheet.

It is yet another object, according to one embodiment of this invention, to provide a multi-color ink-supply method for duplicating machines whereby liquid inks of different colors can be applied to a plastic film for transfer by the impact element to a copy sheet.

These and other objects and advantages of the present invention will be apparent to those skilled in the art in the light of the present disclosure, including the drawing, in which.

The present invention involves the discovery that thin ink-receptive, ink-impervious films have many advantages over conventional duplicating ribbons and that such films can be used in association with a liquid ink supply to receive on their transfer surface a uniform, continuous thin supply of liquid ink for transfer to a copy sheet under the effects of impact pressure such as applied by a type face, minimizing the broadening effect caused by the interposed transfer element. By "ink-impervious" is meant that the ink cannot penetrate through the film to the back surface or to the type faces.

The ink-receptive films useful in the present method are those which are oleophilic, either chemically or physically. Chemically oleophilic films include polyolefins, such as polypropylene, and films which are not normally oleophilic, such as Mylar polyethylene terepthalate, but which are laminated, coated or otherwise treated to render at least one surface oleophilic. Physically olephilic films are those which are etched or porous or coated to render at least one surface porous and ink-receptive.

The means for supplying liquid ink to the present films is preferably a soft sponge roller which is impregnated with a supply of liquid ink and which is either associated with a continuous supply of liquid ink or is replaceable after an extended period when its ink supply decreases. Alternatively the ink supply may comprise a roller which receives liquid ink from an ink well and applies it to the oleophilic film surface.

Figure 1:
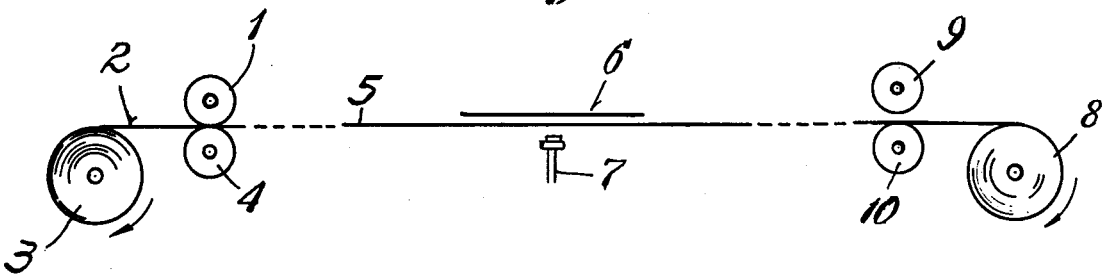
FIGS. 1 and 2 are diagrammatic top views of devices for carrying out different ink-supply methods according to different embodiments of the present invention.

FIG. 1 of the drawing illustrates the use of a soft, spongy, ink-impregnated inking roller 1 and an ink-receptive film ribbon 2. The ribbon 2, such as surface-treated 0.5 mil polypropylene, is expended from supply spool 3 into the nip of inking roller 1 and backing roller 4 to provide a uniform, continuous, thin, liquid ink coating 5 on the treated ink-receptive surface of the film ribbon 2. The ink-coated ribbon is then guided into a printing station between a copy sheet 6 and a type bar 7 in conventional manner. The compression of the ink-coated film between the face of the type bar 7, which strikes the uncoated surface of the film 2, and the copy sheet 6 under impact pressure causes the liquid ink to transfer to the copy sheet in areas corresponding to the impact. The images formed on the copy sheet are free of fabric weave imprint and are sharper and clearer than images formed by a fabric ribbon and yet have the smudge-resistance and cleanliness of a fabric ribbon copy due to the absorption of the liquid ink by the copy sheet. The used film ribbon is then guided to take-up spool 8 where it is collected.

When the entire film ribbon is collected on take-up spool 8, spools 8 and 3 can be interchanged and the film ribbon can be reused, or a reversing mechanism can be provided together with a second inking roller 9 (shown out of contact with the ribbon) and a second backing roller 10 positioned adjacent the take-up spool 8. When the ribbon is reversed, the first inking roller 1 moves out of contact with the ribbon and the second inking roller 9 moves into position to contact the ribbon between itself and backing roller 10 and supply a fresh coating of the same liquid ink at least to the areas from which ink has been removed during the previous transport.

Figure 2:
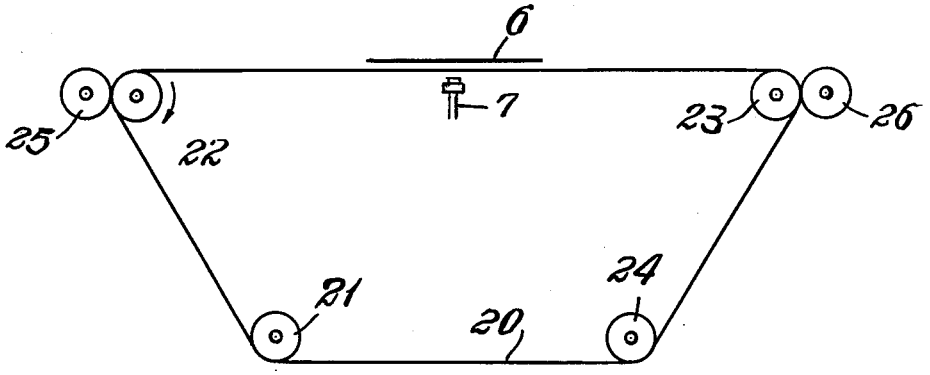

FIG. 2 of the drawing illustrates a continuous film ribbon band which requires no reversing mechanism. The ribbon band 20 is conveyed by rollers 21, 22, 23 and 24 and is contacted by inking roller 25 and by optional inking roller 26.

In operation the continuous ribbon band 20, such as 0.5 mil polyethylene terephthalate polyester (Mylar) carrying a thin, non-transferable oleophilic coating, is moved into pressure contact with inking roller 25 which transfers a thin, continuous film of liquid ink to the oleophilic coating. The inked ribbon passes into the printing station between the copy sheet 6 and the type element 7 which causes pressure-transfer of the liquid ink to the copy paper in image form where the liquid ink is absorbed to form clean, smudge-free images devoid of any wax or resin binder material. The used portion of the ribbon is thereafter reinked, either by its next pressure contact with inking roller 25 or by pressure contact with both the optional similar inking roller 26 and inking roller 25.

According to one embodiment, the roller 26 is a deinking roller comprising a porous ink-absorbing sponge which removes at least a substantial portion of the thin ink film remaining on the used ribbon band 20 so that the band can be freshly reinked with a uniformly thin liquid ink film by means of inking roller 25. This prevents the build-up of stale ink on the band 20, particularly in those areas which are never contacted by the type element 7.

Figure 3:
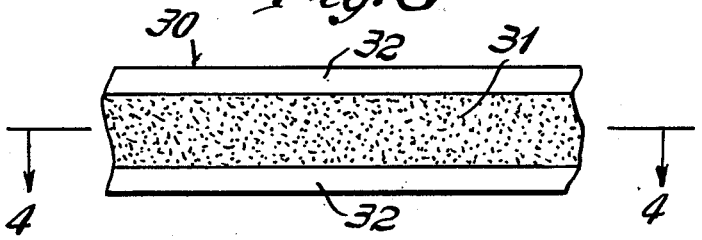
FIG. 3 is a top plan view of a section of ribbon used according to one embodiment of the present invention.
Figure 4:
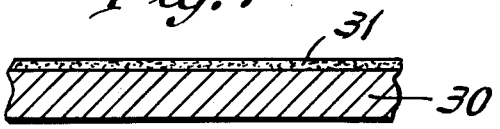
FIG. 4 is a diagrammatic cross-section taken along the line 4—4 of FIG. 3.

FIGS. 3 and 4 illustrate an ink-receptive ribbon film for use according to one embodiment of the present invention. The ribbon comprises a film foundation 30 carrying a thin central ink-receptive strip 31 surrounded on both sides with non-ink-receptive margins 32 which may comprise oleophobic foundation 30 but preferably are strips of oleophobic coating having the same thickness as central strip 31 whereby the ribbon winds evenly on the spools 3 and 8 of FIG. 1.

The ribbon preferably has a strong foundation such as 1 mil polyethylene terephthalate polyester and carries a coating which is oleophobic except in the central area 31 where it is treated to render it porous and oleophilic or ink-receptive. For example, a thin coating can be applied to the film foundation 30 comprising a solution of a vinyl resin such as vinyl chloride-vinyl acetate copolymer containing a particulate, leachable salt or containing a heat-activatable blowing agent. After solidification of layer 32 by evaporation of the solvent, the central strip area 31 can be selectively treated with solvent such as water to remove the salt in that area, or can be selectively heated to activate the blowing agent in that area, whereby a porous, ink-receptive central strip 31 is provided. Alternatively a thin strip 31 of foamed synthetic thermoplastic polymer such as a polyurethane can be formed on the center of the film foundation 30 or preformed and laminated thereto.

The essence of the present invention is the provision of a thin layer of liquid, non-drying ink on the oleophilic surface of a thin plastic film ribbon which, either naturally or by means of surface treatment or coating, has an ink-receptive surface capable of accepting a uniform, thin film of conventional liquid ribbon ink, comprising non-drying oil and coloring matter, and capable of releasing such ink to a copy sheet under the effects of imaging pressure. Naturally-oleophilic plastic films are known in the art. Also it is known in the art to treat films with corona discharge to improve their oleophilic properties, and to coat films with hydrolyzable compositions such as titanium tetrachloride and to conduct hydrolysis to form a thin, ink-receptive coating on the film. Similarly it is known to include blowing agents in a thin plastic film or in a thin plastic coating thereon and to activate the blowing agent to form ink-receptive pores therein. Any of these and other well known means may be used to provide the ink-receptive film used according to the present invention.

According to one embodiment of the present invention, the plastic film ribbon used in the present method comprises a laminate of thin plastic films bonded together by means of a thin bonding layer. For instance, two films of 0.5 mil tensilized Mylar bonded together by means of from 0.1 to 1 mil thickness of adhesive such as polyvinylidene chloride or isocyanate-cured polyurethane which functions to cushion the typing pressure, provide a ribbon having high strength and cut-resistance. Similarly a laminate of 0.5 mil Mylar and 0.5 mil polyethylene or polypropylene provides a ribbon having the strength of Mylar and the oleophilic properties of the polyolefin film. Also thin porous films or sponges may be laminated to a support film such as tensilized Mylar to provide a ribbon having high strength and ink-absorbency.

The inking rollers preferably are of the conventional porous elastomer type commercially available under the trademark "Micro-well" from Elastolabs Corporation or available from S. C. Johnson & Son, Inc. under the trademark "Porelon". However the ink-applying means may be any means, such as an application roller associated with an ink vat, inked felt, or the like, capable of bringing a thin, continuous supply of conventional non-drying liquid ink into contact with the ink-receptive transfer surface of an ink-impervious film ribbon or band. The essential requirement of the latter is that it is oleophilic, either chemically or physically. By this is meant that the surface of the ribbon which receives the ink supply must be capable of retaining the ink as a continuous thin layer rather than repelling the ink and causing it to contract on the film in the form of droplets, leaving portions of the film surface free of an ink supply.

In general, the film ribbons used in the present method have a thickness which may vary from a minimum of about 0.5 mil up to a maximum of about 5 mils. The thickness depends upon whether a coating or sponge layer is present on the film and whether the strength of the ribbon or the quality of the copy is more important to the particular use being made of the ribbon. Lesser thicknesses are preferred in most cases since a thin ribbon transfers the ink to the copy sheet without substantially broadening the imaging pressure whereby the formed images are sharp and clear as well as being smudge-resistant.

Variations and modifications may be made within the scope of the claims and portions of the improvements may be used without others.

I claim:

1. Continuous duplicating method in which an inked ribbon is continuously moved into and out of a printing station into transfer position between a copy sheet and a printing member, ink being transferred from said ribbon to said copy sheet by means of energy applied to said ribbon by said printing member each time said ribbon enters said printing station, comprising the steps of providing an ink-impervious plastic film ribbon selected from the group consisting of chemically-oleophilic plastic films, plastic films which are treated to render them chemically-oleophilic and plastic films which are etched or coated to render one surface porous and physically-oleophilic having an ink-transfer surface which is receptive to liquid non-drying oil ink, contacting said ink-transfer surface with an ink-application roller containing a supply of liquid non-drying oil ink comprising liquid non-drying oil and pigment to apply a uniform, continuous, thin coating of said liquid non-drying ink to the ink-transfer surface of said plastic film ribbon, moving said ink-coated plastic film ribbon to said transfer position and applying a printing energy against the uncoated surface of said plastic film ribbon by means of said printing member to cause corresponding portions of said liquid ink coating to transfer to said copy sheet, moving said plastic film ribbon out of said transfer position, applying an additional amount of said liquid non-drying ink to the ink-transfer surface of said plastic film ribbon, at least in areas from which said ink has been transferred to said copy sheet, and reintroducing said ink-coated plastic film ribbon to transfer position in said printing station.

2. Continuous duplicating method according to claim 1 in which said supply of thin plastic film is a continuous belt of said film.

3. Continuous duplicating method according to claim 1 in which said supply of thin plastic film is a length of plastic film adapted for alternate movement in either direction to said transfer position, and said uniform thin coating of liquid ink is applied to said plastic film in advance of said transfer position as the plastic film moves to said transfer position from either direction.

4. Continuous duplicating method according to claim 1 in which the oleophilic surface of said thin plastic film comprises an oleophilic coating present on said film.

5. Continuous duplicating method according to claim 1 in which the thin plastic film is one which is oleophilic, per se.

6. Continuous duplicating method according to claim 1 in which the thin plastic film comprises a laminate of two thin plastic films.

7. Continuous duplicating method according to claim 1 which comprises applying said uniform thin coating of ink by means of a porous sponge roller impregnated with said liquid ink which pressure-engages the oleophilic surface of the plastic film.

8. Continuous duplicating method according to claim 1 which comprises removing a substantial portion of the unused ink remaining on said plastic film after said film passes said transfer position and prior to the application to the plastic film of a new continuous coating of said liquid non-drying ink.

* * * * *